US007247785B2

(12) United States Patent
Annen

(10) Patent No.: US 7,247,785 B2
(45) Date of Patent: Jul. 24, 2007

(54) ELECTRONIC MUSICAL INSTRUMENT AND METHOD OF PERFORMING THE SAME

(75) Inventor: Shingo Annen, Matsudo (JP)

(73) Assignees: Vestax Corporation, Tokyo (JP); Shingo Annen, Chiba (JP)

( * ) Notice: Subject to any disclaimer, the term of this patent is extended or adjusted under 35 U.S.C. 154(b) by 332 days.

(21) Appl. No.: 10/382,586

(22) Filed: Mar. 7, 2003

(65) Prior Publication Data

US 2003/0167907 A1 Sep. 11, 2003

(30) Foreign Application Priority Data

Mar. 7, 2002 (JP) ..... 2002-108579

(51) Int. Cl.
*G10H 1/00* (2006.01)

(52) U.S. Cl. ..... 84/615; 84/653; 84/678

(58) Field of Classification Search ..... 84/615, 84/653–658, 678, 633, 665, 711, 7, 690, 723–731; 381/118, 119

See application file for complete search history.

(56) References Cited

U.S. PATENT DOCUMENTS 2,873,637 A * 2/1959 Herold ..... 84/687
3,694,559 A * 9/1972 Suzuki et al. ..... 84/744
4,885,792 A * 12/1989 Christensen et al. ..... 381/119
5,010,799 A 4/1991 Tanaka et al.
5,054,077 A * 10/1991 Suzuki ..... 381/109
5,138,926 A 8/1992 Stier et al.
5,227,573 A 7/1993 Nakano
5,290,964 A 3/1994 Hiyoshi et al.
5,317,641 A * 5/1994 Yasuda et al. ..... 381/119
5,608,807 A * 3/1997 Brunelle ..... 381/119
5,723,805 A * 3/1998 Lacombe ..... 84/727
5,852,800 A * 12/1998 Modeste et al. ..... 704/270.1
6,610,917 B2 * 8/2003 Ludwig ..... 84/726
2002/0108484 A1 * 8/2002 Arnold et al. ..... 84/615
2002/0136419 A1 * 9/2002 Santos ..... 381/119

FOREIGN PATENT DOCUMENTS

EP 0322825 A2 7/1989

* cited by examiner

*Primary Examiner*—Lincoln Donovan
*Assistant Examiner*—David S. Warren
(74) *Attorney, Agent, or Firm*—Sughrue Mion, PLLC

(57) ABSTRACT

The electronic musical instrument comprises a plurality of slide-type faders (1), an interval setup device (5, 6), and a sound synthesis device (20). The slide-type faders are provided correspondingly to a plurality of tones included an interval and allow slide operations to change output sound volume. The interval setup device means sets the interval to define a tone for each slide-type fader. The sound synthesis device synthesizes sounds according to a volume changing pattern with predefined sound quality and based on operations of the slide-type fader. The slide-type faders can be manipulated by fingertips or the like for musical performance to enjoy the DJ play without many practices or high proficiency.

12 Claims, 4 Drawing Sheets

POSITION DATA TABLE WHEN AN ANALOG FADER STROKE IS CODED INTO 8-BIT 256 GRADATIONS

ELECTRONIC MUSICAL INSTRUMENT AND METHOD OF PERFORMING THE SAME

FIELD OF THE INVENTION

The present invention relates to an electronic musical instrument by using a plurality of slide-type faders preassigned with a series of tones based on a specified musical scale and to a method of playing the electronic musical instrument.

BACKGROUND OF THE INVENTION

A DJ play mixes different musics and reproduces the musics called non-stop remixes for a long period of time without interruption. The DJ play drastically develops by adopting the "scratch" technique which appeared in 1990s and uses the slide rheostat or resistor called the fader to create a rhythm by chopping up a music. The advent of this technique enables DJ devices such as a record player, CD, DJ mixer, etc. to be used like musical instruments. As a result, a new music genre was established and has become popular to the young generation.

When DJ devices are used like musical instruments in a way completely different from that for conventional stringed or keyboard instruments, phonographic records or CDs are only presently available sound sources. Accordingly, the power of expression is greatly restricted.

In order to enhance the power of expression, it may be possible to use a computer or a keyboard instrument. However, it is difficult to demand many practices and high proficiency from users in order to master the computer or the keyboard instrument anew in the field of DJ plays where many users create musics with acute sensitivity and based on their intuition. This makes it difficult for users to easily create music suitable for the DJ play.

SUMMARY OF THE INVENTION

The present invention has been made in consideration of the foregoing. It is therefore a first object of the present invention to provide an electronic musical instrument which can expand the power of expression by diversifying sound sources in order to enjoy a DJ play using DJ devices like musical instruments and can easily create and perform music appropriate for the DJ play without needing many practices and high proficiency. It is a second object of the present invention to provide a method of performing such electronic musical instrument.

According to the present invention, the first object is achieved by an electronic musical instrument comprising:

a plurality of slide-type faders for changing sound volume of tones included in a musical scale, the respective slide-type faders being provided with the respective tones;

a scale setup means for setting said musical interval to define the respective tones of the respective slide-type faders; and a sound synthesis means for synthesizing sounds having the respective tones with predefined sound quality, the changing pattern of sound volume of the respective sounds being defined based on operation of the respective slide-type faders.

A slide rheostat or resistor is appropriate for the slide-type fader to be used here. It is preferable to use slide-type faders not fewer than the number of tones included in an octave. For example, a chromatic scale begins a new cycle of an octave at the 13th semitone, forming a whole-tone scale (diatonic scale) in which seven steps correspond to seven notes for moving up and down 12 semitones. In this case, it is preferable to use at least eight slide-type faders.

The scale setup means is preassigned with a plurality of scales such as the major scale (MAJOR), minor scale (MINOR), the other seven-note scales (natural minor scale, harmonic minor scale, melodic minor scale), and special scales used for folk or ethnic music. Selecting any scale can assign each slide-type fader with each pitch of the selected scale.

In this case, it is preferable to provide an assign key for assigning each slide-type fader with a tone included in the selected scale. For example, the assign key is used to set C-Major, D-Major, and so on, and C-Minor, D-Minor, and so on.

The slide-type fader enables performance using tones over an octave if there is provided an octave changeover switch that moves an interval up or down in units of octaves. The octave changeover switch may be provided to the respective slide-type faders as the number of tones or notes included in one octave. It may be preferable to provide a master octave changeover switch, i.e., a switch that changes all scales of all the slide-type faders in units of octaves at time.

The sound synthesis means synthesizes sounds through an electronic circuit and may comprise: an AD converter which converts an output in proportion to the slide-type fader operation amount (stroke amount) into a digital signal; a CPU which issues a command for making a sound having predetermined characteristics defined by the digital signal; a DSP which outputs specified timbre data based on the command; and a DA converter which converts the timbre data output from the DSP into an analog signal. The analog signal output from the DA converter is amplified in an amplifier to drive a speaker in a manner similar to that for the ordinary audio equipment.

The CPU issues a command to the DSP wherein the command not only specifies selection of the sound generation, envelope, sustain sound, and decay sound, but also indicates a sound volume. It may be preferable to add a key fader curve changeover switch to specify change characteristics of an output sound volume corresponding to a stroke amount of the slide-type fader. For example, this switch may be configured to select to gradually increase or decrease sound output with the lapse of time or to make the sound output constant, enabling more diversified performance.

The sound synthesis means can use various sound sources. An external storage medium can be used to store sound source data in advance and this data can be read for use. If the sound from a microphone, phonographic record, or CD is converted into a digital signal, the DSP can process and store this data in memory. The data can be read out for use.

According to the present invention, the second object is achieved by a method of performing an electronic musical instrument comprising the steps of: assigning tones included in a musical scale with different tones predefined by a sound synthesis means to a plurality of slide-type faders whose slide operation changes volume outputs; and varying operation strokes and operation speeds of the slide-type faders.

DETAILED DESCRIPTION OF THE PREFERRED EMBODIMENTS

Figure 1:
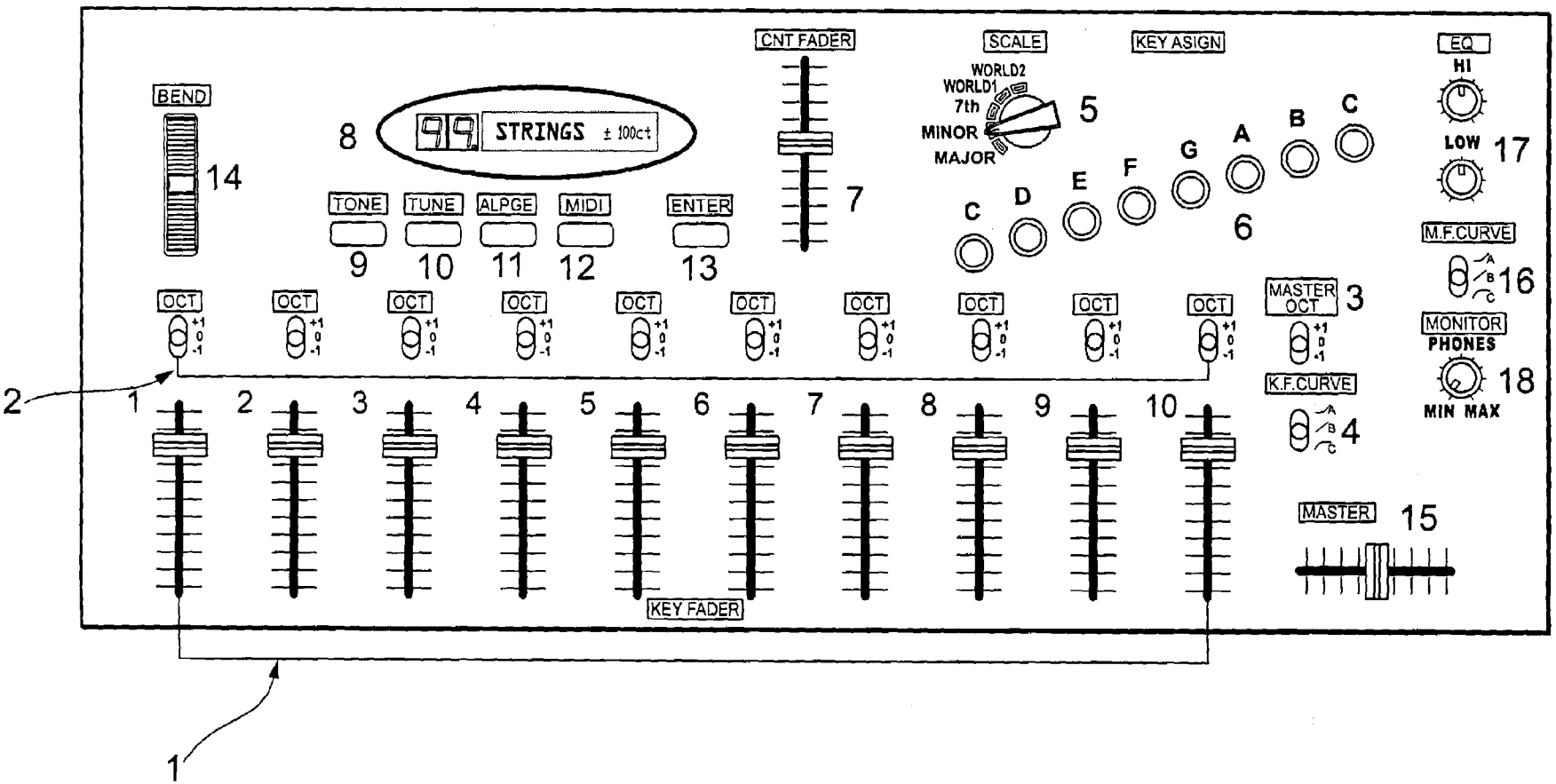
FIG. 1 is a front view of an electronic musical instrument as an embodiment of the present invention.
Figure 2:
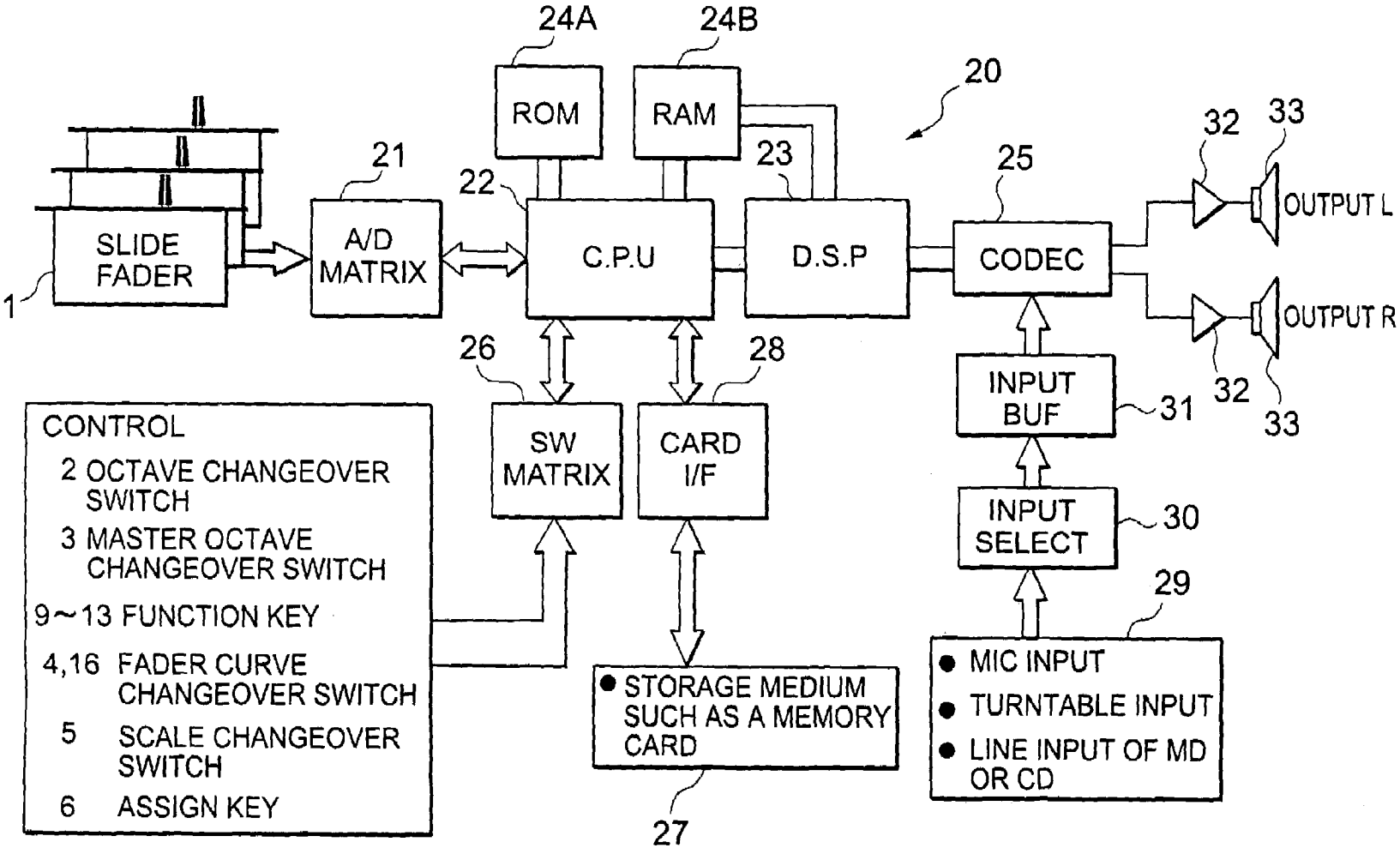
FIG. 2 shows a configuration of a sound synthesis means used in the embodiment.
Figure 3:
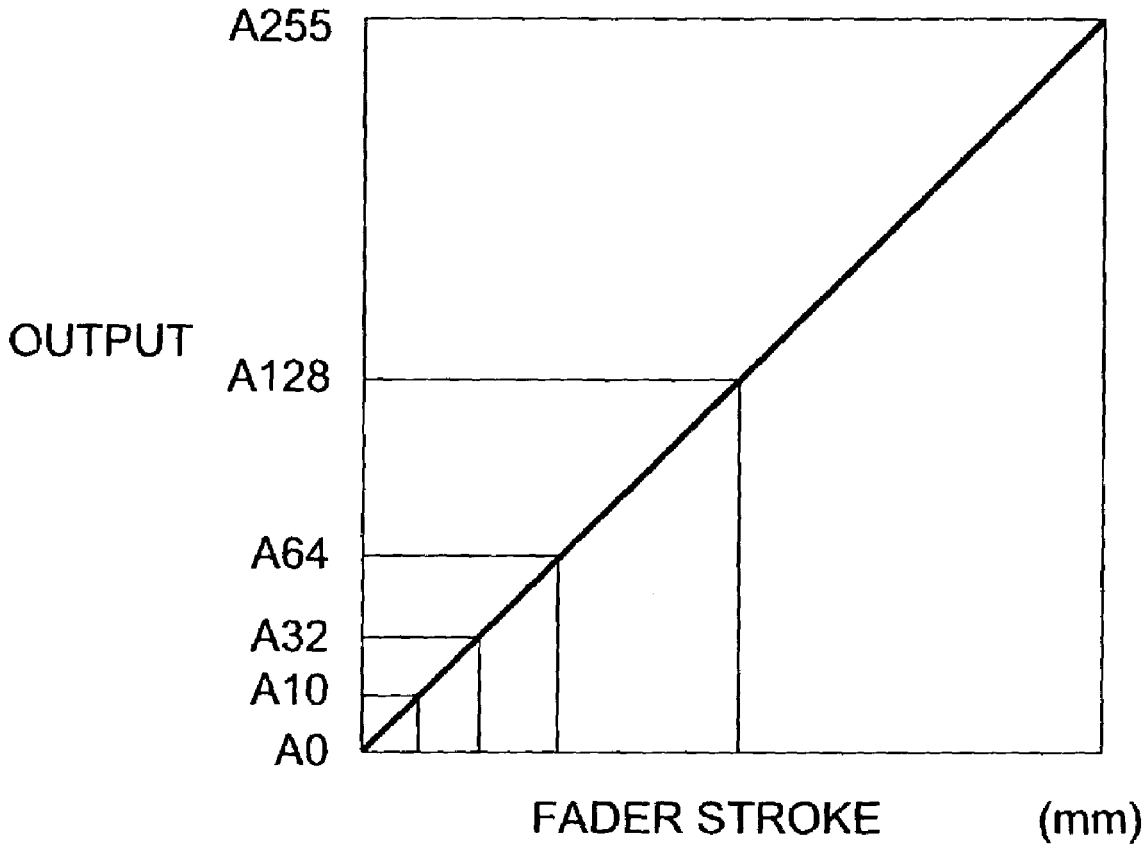
FIG. 3 shows output characteristics of a slide-type fader.

In FIGS. 1 and 2, the reference numeral 1 represents a series of the slide-type faders comprising a group of ten keys. The respective slide-type faders 1 uses, for example, a slide rheostat or resistor and changes its output or an output voltage in accordance with the slide amount (stroke amount) of a key. As shown in FIG. 3, it is desirable that the output (voltage) changes in direct proportion to the stroke changes. The group of ten keys 1 is arranged so that a performer can simultaneously touch the keys 1 with fingertips of his or her both hands. Each key moves back and forth from the performer's viewpoint.

The reference numeral 2 represents an octave changeover switch that is provided for each slide-type fader 1. The toggle switch 2 is rockable back and forth (to the lower and upper direction in FIG. 1) and can automatically return to a neutral position. The toggle switch 2 increases or decreases a tone or pitch for the corresponding slide-type fader or key 1 on an octave basis. Pressing up the toggle switch 2 once and then returning it to the neutral position raises the tone one octave higher. Pressing up the toggle switch 2 for a specified number of times raises the tone higher for the corresponding number of octaves. Likewise, pressing down the toggle switch 2 for a specified number of times drops the tone lower for the corresponding number of octaves.

The reference numeral 3 represents a master octave changeover switch which simultaneously increases or decreases tones of all the slide-type faders 1 on an octave basis. There is provided only one toggle switch 3 having the same structure as that of the octave changeover switch 2.

The reference numeral 4 represents a key fader curve changeover switch. The selection switch 4 can be set to three positions, i.e., neutral (B), forward (A), and backward (C), for specifying change characteristics of an output sound volume in accordance with the stroke amount of the slide-type fader 1. That is to say, the selection switch 4 changes fader curves to three types.

The reference numeral 5 represents a scale changeover switch. The switch 5 changes the musical scale of sound to be generated to the major scale (Major), minor scale (Minor), seven-tone scale (7th), folkloric scales (world1, world2), etc.

The reference numeral 6 represents eight assign keys C (do), D (re), . . . , and C used for setting a tone or note of the scale selected by the scale changeover switch 5. For example, it is assumed that the switch 5 is used to select the major scale (Major) and the assign key marked with "C" is pushed to be selected. In this case, tones or pitches included in a scale of C-Major is assigned to the ten slide-type faders 1 from the left to the right. The scale changeover switch 5 and the assign keys 6 constitute a scale setup means.

TABLE 1

| | SCALE set to MAJOR | | | | | | | | | |
|---|---|---|---|---|---|---|---|---|---|---|
| Scale Selected by | Tone Specified to the Fader Nos. | | | | | | | | | |
| Assign Key | 1 | 2 | 3 | 4 | 5 | 6 | 7 | 8 | 9 | 10 |
| C | C | D | E | E# | G | A | B | B# | D | E |
| D | D | E | F | F# | A | B | C | C# | E | F |
| E | E | F | G | G# | B | C | D | D# | F | G |
| F | F | G | A | A# | C | D | E | E# | G | A |
| G | G | A | B | B# | D | E | F | F# | A | B |
| A | A | B | C | C# | E | F | G | G# | B | C |
| B | B | C | D | D# | F | G | A | A# | C | 0 |
| C | C | D | E | E# | G | A | B | B# | D | E |

TABLE 2

| | SCALE set to MINOR | | | | | | | | | |
|---|---|---|---|---|---|---|---|---|---|---|
| Scale Selected by | Tone Specified to the Fader Nos. | | | | | | | | | |
| Assign Key | 1 | 2 | 3 | 4 | 5 | 6 | 7 | 8 | 9 | 10 |
| C | C | D | D# | F | G | G# | B | C | D | D# |
| D | D | E | E# | G | A | A# | C | D | E | E# |
| E | E | F | F# | A | B | B# | D | E | F | F# |
| F | F | G | G# | B | C | C# | E | F | G | G# |
| G | G | A | A# | C | D | D# | F | G | A | A# |
| A | A | B | B# | D | E | E# | G | A | B | B# |
| B | B | C | C# | E | F | F# | A | B | C | C# |
| C | C | D | D# | F | G | G# | B | C | D | D# |

Table 1 lists tones allotted to the slide-type faders 1 corresponding to the selected assign key 6 when the toggle switch (scale changeover switch) 5 is used to select "Major". Likewise, Table 2 lists tones allotted to the slide-type faders 1 corresponding to the selected assign keys 6 when the toggle switch (scale changeover switch) 5 is used to select "Minor".

The reference numeral 7 represents a control fader to select parameters for function keys 9 through 12 to be described. The reference numeral 8 denotes a display panel. The function key 9 is used to set a timbre. Pressing the function key 9 defines a timbre to be assigned to the slide-type faders 1. When the function key 9 is pressed, for example, numbers on the display panel 8 start blinking. Moving up or down a control fader 7 selects one of 99 timbres 01 through 99. Pressing an enter key 13 determines the timbre. Pressing the enter key 13 causes the numbers on the display panel 8 to light steadily, indicating that the specified timbre is assigned.

The reference numeral 10 represents a function key for tuning (TUNE). Pressing the key 10 once can change the tuning by a half tone (100 cents) sharp or flat. That is to say, pressing the key 10 once enables the tuning mode. Moving the control fader 7 up or down can provide tuning by a half tone (100 cents) sharp or flat.

The reference numeral 11 represents a function key for arpeggio setting. Pressing the key 11 enables automatic performance based on a predetermined sequence. The reference numeral 12 represents a function key used for setting various parameters when an external sound source is used with MIDI (Musical Instrument Digital Interface) system.

The reference numeral 13 represents the enter key used to determine parameters for the function keys 9 through 13.

The reference numeral 14 represents a bend wheel. Rotating the wheel 14 back and forth can change a tone or pitch of the generated sound by a whole tone up or down. The reference numeral 15 represents a master fader and controls a master volume (not shown) for the sound. Moving the fader 15 to the right end provides the maximum sound volume.

The reference numeral 16 represents a master fader curve changeover switch. The switch 16 can select one of fader curves A, B, and C for the master fader 15. The reference numeral 17 represents a master equalizer, i.e., a 2-band master equalizer. The reference numeral 18 represents a level volume for headphone monitoring.

In FIG. 2, the reference numeral 20 represents a sound synthesis means. The sound synthesis means 20 comprises an AD converter (A/D Matrix) 21; a CPU 22; a DSP (Digital Signal Processor) 23; memory 24 (24A and 24B) comprising ROM and RAM; and a CODEC (Coder-Decoder) 25. The AD converter 21 converts an output (voltage) in proportion to the stroke amount of the slide-type fader 1 into a digital signal. The CPU 22 receives the digital signal from the AD converter 21 and issues a command for making a sound having predetermined characteristics based on the digital signal.

Specifically, the CPU 22 issues a specified command based on signals determined by the slide-type fader 1, the octave changeover switches 2 and 3, the scale selection switch 5, the assign key 6, the function keys 9 through 13, the fader curve changeover switches 4 and 16, and the like. The CPU 22 is supplied with signals from the switches 2, 3, 4, 5, and 16, and keys 6, 9 through 13 via a switch (SW/Matrix) 26.

The DSP 23 is a so-called sound synthesis LSI and artificially produces sound through digital signal processing. The memory 24 (sound ROM 24A and RAM 24B) stores digitized sound signals or rules for generating sound and timbre data. The DSP 23 synthesizes or combines sounds based on the contents of the memory 24.

The CPU 22 can be supplied with sound source data (timbre data) stored in a storage medium 27 such as an external memory card via an interface (CARD I/F) 28. More diversified performance becomes available through the use of sounds in the external storage medium 27. A user can unlimitedly increase timbre variations using his or her custom-made sampling sounds or computer-based data files.

The CODEC 25 is an integration of a digital coder and a digital decoder. The CODEC 25 is used to make it possible to use an external sound source 29, other than the timbre data stored in the ROM 24A; and data read from the external storage medium 27, digitally processed and stored in the RAM 24B.

More specifically, the CODEC 25 is supplied with an output (analog signal) from the external sound source 29 such as a microphone, a record turntable, an MD (Mini-Disc), or a CD (compact disk) via an input toggle switch (Input Select) 30 and an input buffer (Input BUF) 31. The CODEC 25 converts the input signal (analog signal) into a digital signal and sends it to the DSP 23. The DSP 23 digitally processes the signal and stores it in the RAM 24B so as to be used as timbre data.

The DSP 23 reads timbre data corresponding to a specified sound source from the memory 24 based on a command issued from the CPU 22 and uses data read from the ROM 24A to synthesize sounds.

When the sounds are synthesized into a digital signal, the CODEC 25 converts this signal into an analog signal. The signal is then split into right and left signals which are amplified in amplifiers 32 and are transmitted to right and left speakers 33, respectively.

The following describes a method of controlling sound sources according to the apparatus. First, as mentioned above, the settings are configured for the function keys 9 through 13, the scale changeover switch 5, and the assign key 6. The AD converter 21 is used to digitize (code) a full stroke (entire slide range) for any one of the ten slide-type faders 1. Based on this data, the sound synthesis means 20 controls sound generation and envelopes.

When the 45 -mm stroke length is coded into 8-bit 256 gradations (A0 to A255), the sound source is controlled as shown in FIGS. 4A through 4D. It is assumed that the key of the slide-type fader 1 is moved from the bottom to the top in FIG. 4A. When the key reaches position A10, the sound generation starts. Thereafter, the volume of sustain sound proportionally increases until the key reaches position A255 where the volume becomes maximum. Moving down the fader 1 decreases the volume. The sustain sound stops at position A9.

Figure 4A:
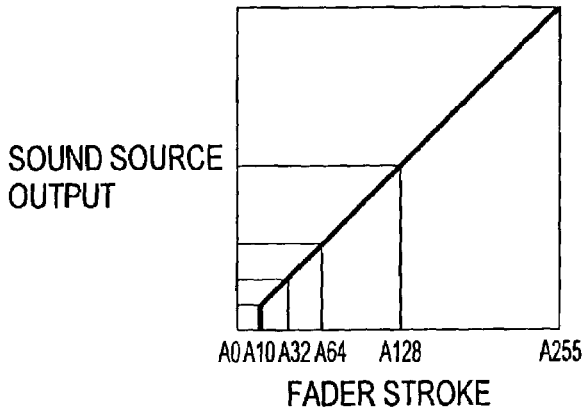
FIGS. 4A-4D show examplanatory characteristics of sound source output corresponding to a fader stroke amount.
Figure 4B:
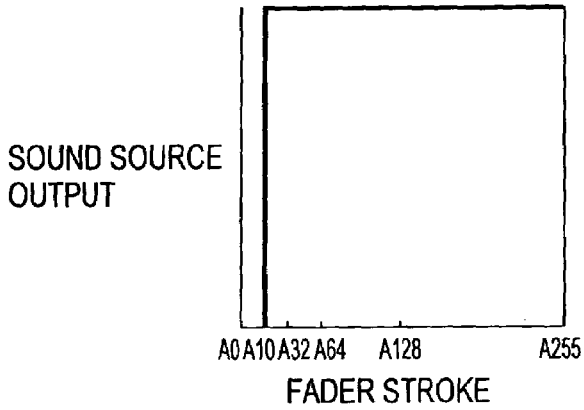

Likewise in FIG. 4B, the sound generation starts at position A10 with the maximum volume. The sustain sound is continuously output up to position A255 with this volume unchanged. Moving down the fader stops the sustain sound at position A9.

Figure 4C:
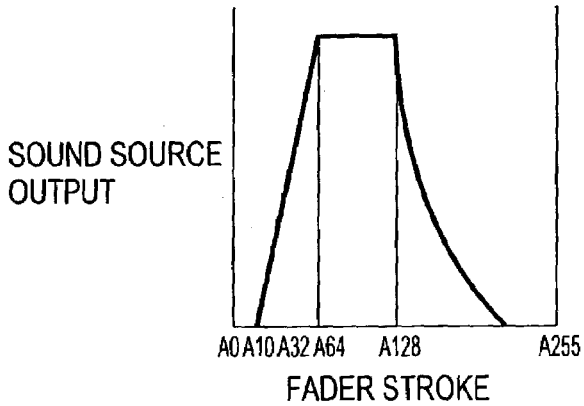

Likewise in FIG. 4C, the sound generation starts at position A10. The sustain sound volume increases in proportion to the stroke amount of the fader 1 between positions A10 through A64. Between positions A64 and A128, the sustain sound is output with a constant volume. At position A129, the sustain sound is released, and the attenuation control mechanism (sustain) starts operating. The sound attenuates in accordance with characteristics predetermined by the sound synthesis means 20.

Figure 4D:
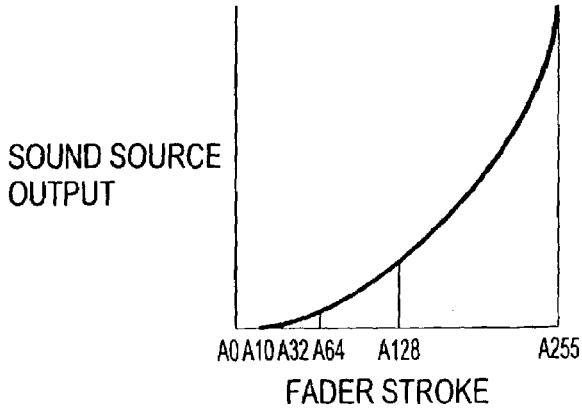

Likewise in FIG. 4D, the sound generation starts at position A10. Thereafter, the sustain sound amount gradually increases up to position A254 based on exponential curve characteristics. The sustain sound volume becomes maximum at position A255.

In this manner, a performer presets volume change characteristics corresponding to the stroke amount of the fader 1 in accordance with his or her preferences. Then, the performer positions his or her fingers of both hands to the ten faders 1. Moving up one or more of any faders can output the sound with an intended tone or pitch. Diversified performance is available by changing positions and speeds for moving the fader 1.

The tone or pitch of the respective faders 1 can be changed in units of octaves using the octave changeover switches 2 and 3. Therefore, it is possible to perform wide-range music.

The faders 1 can be used to control the sound generation and envelopes (patterns of volume change in time course) in two ways. The first method uses the fader curve toggle switch 4 for choosing from three general fader (envelope) curves (A, B, and C) to control envelopes. This method is mainly used for sampled timbres.

The second method uses the memory 24 (ROM 24A and RAM 24B) to store timbre data in advance. According to this method, the memory 24 stores programmed data in accordance with various envelope curves as shown in FIGS. 4A through 4D. It is possible to optimize the preset timbre data. That is to say, this method is appropriate for preset timbres.

As mentioned above, according to the present invention, tones or notes are assigned to a plurality of slide-type faders and the slide-type fader is operated to change an output sound volume of the sound synthesized by the sound synthesis means. Accordingly, it is possible to diversify sounds of the sound source and enhance the power of musical expression.

Since the slide-type faders can be manipulated by fingertips or the like for musical performance, everyone can easily enjoy the DJ play without many practices or high proficiency.

What is claimed is:

1. An electronic musical instrument comprising:

a plurality of slide-type faders for changing sound volume of respective tones included in a musical scale, the respective slide-type faders being provided with the respective tones;

a scale setup means for setting said musical scale to define the respective tones of the respective slide-type faders; and a sound synthesis means for synthesizing sounds having the respective tones with predefined sound quality, the changing pattern of sound volume of the respective sounds being defined based on operation of the respective slide-type faders.

2. The electronic musical instrument according to claim 1, wherein the slide-type fader is a slide rheostat.

3. The electronic musical instrument according to claim 1, wherein the number of said plurality of the slide-type faders is not less than the number of tones included in an octave.

4. The electronic musical instrument according to claim 1, wherein said scale setup means specifies the tones of at least one octave included in a predetermined scale for each slide-type fader.

5. The electronic musical instrument according to claim 4, wherein said scale setup means comprises:

a scale changeover switch for changing at least major and minor scales; and an assign key for assigning the tone for a scale selected by the scale changeover switch to said plurality of slide-type faders.

6. The electronic musical instrument according to claim 1, further comprising an octave changeover switch for varying the tone provided to the respective slide-type faders in units of octaves.

7. The electronic musical instrument according to claim 1, further comprising a master octave changeover switch for varying the tones of all of the slide-type faders in units of octaves.

8. The electronic musical instrument according to claim 1, wherein said sound synthesis means comprises:

an AD converter for converting an output in proportion to the slide-type fader operation amount into a digital signal;

a CPU for issuing a command for making a sound having predetermined characteristics based on the digital signal;

a DSP for outputting specified timbre data based on the command issued from the CPU; and a DA converter for converting the timbre data output from the DSP into an analog sound signal.

9. The electronic musical instrument according to claim 8, wherein said CPU issues a command to the DSP, the command including an instruction of a sound volume and at least one of predefined sound generation, envelope, sustain sound, and decay sound.

10. The electronic musical instrument according to claim 1, further comprising a key fader curve changeover switch for specifying change characteristics of an output sound volume corresponding to a stroke amount of the slide-type fader.

11. The electronic musical instrument according to claim 1, wherein said sound synthesis means synthesizes sounds using sound source data previously stored in an external storage medium.

12. The electronic musical instrument according to claim 1, wherein said sound synthesis means synthesizes sounds using sound source data which is a digital signal converted from analog output of an external sound source.

* * * * *